US005304764A

United States Patent [19]

Kobayashi

[11] Patent Number: 5,304,764

[45] Date of Patent: Apr. 19, 1994

[54] FLAT KEYBOARD SWITCH

[75] Inventor: Makio Kobayashi, Tokyo, Japan

[73] Assignee: Nec Corporation

[21] Appl. No.: 838,051

[22] Filed: Feb. 19, 1992

[30] Foreign Application Priority Data

Feb. 21, 1991 [JP] Japan ..... 3-48898

[51] Int. Cl.[5] ..... H01H 9/16

[52] U.S. Cl. ..... 200/314

[58] Field of Search ..... 200/314

[56] References Cited

U.S. PATENT DOCUMENTS 4,163,883 8/1979 Boulanger ..... 200/314
4,343,975 8/1982 Sado ..... 200/314
5,081,329 1/1992 Mitusinski et al. ..... 200/314

FOREIGN PATENT DOCUMENTS 3346485 7/1985 Fed. Rep. of Germany ..... 200/314
2053574 2/1981 United Kingdom ..... 200/314

*Primary Examiner*—Renee S. Luebke
*Attorney, Agent, or Firm*—Ostrolenk, Faber, Gerb & Soffen

[57] ABSTRACT

A flat keyboard switch comprises a printed circuit board having a plurality of fixed contacts and a light emitting element provided thereon, a diaphragm disposed above the fixed contacts and serving as a movable contact for electrically connecting the fixed contacts to each other, a surface sheet having an indicium printed at a portion thereof above the diaphragm, the indicium being made of a material having a light transmitting property, a movable element disposed between the diaphragm and the surface sheet, a light introducing plate disposed in the neighborhood of the light emitting element for scattering light emitted from the light emitting element toward the movable element, and a light introducing member interposed between the movable element and the light introducing plate being formed as a unitary member together with the movable element and the light introducing plate.

12 Claims, 2 Drawing Sheets

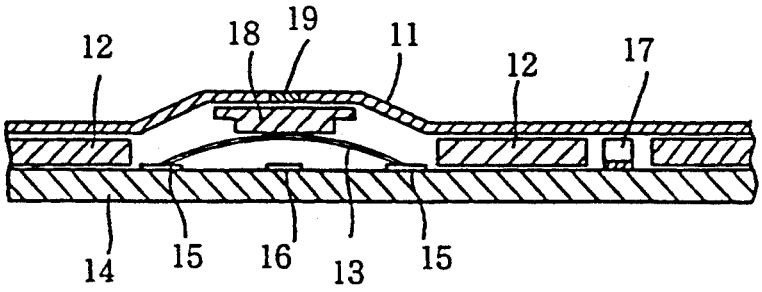
FIG 1 : PRIOR ART
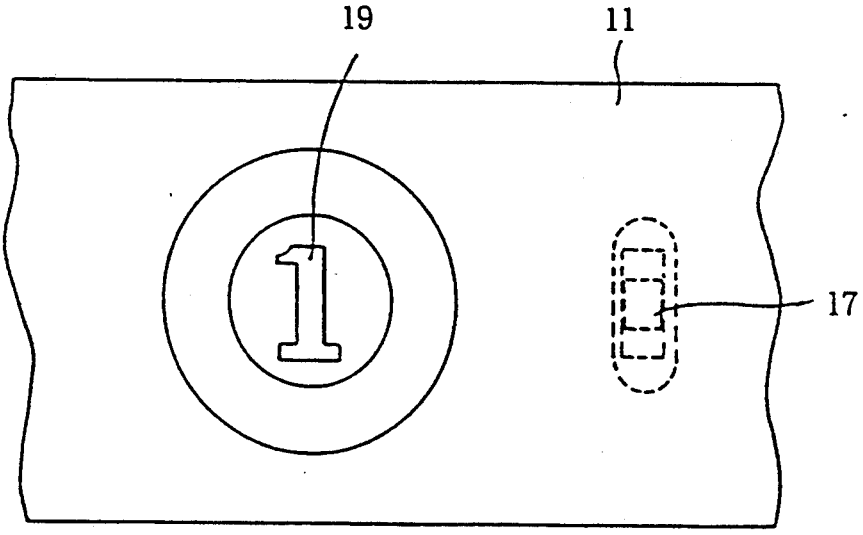
FIG 2 : PRIOR ART

FLAT KEYBOARD SWITCH

BACKGROUND OF THE INVENTION

1. Field of the Invention

This invention relates to a flat keyboard switch of the type which has a built-in light emitting element for illuminating a switching section.

2. Description of the Related Art

Flat keyboard switches of the type mentioned above are already known. An exemplary conventional flat keyboard switch is shown in FIGS. 1 and 2 which are a partial sectional view and a partial plan view with a surface sheet, respectively.

The conventional flat keyboard switch shown includes a pair of fixed contact elements 15 and 16 provided on a surface of printed circuit board 14 and diaphragm 13 in the form of a semi-spherical metal spring plate disposed as a movable contact on fixed contact element 15 above fixed contact element 16, thereby constituting a switching section.

Surface sheet 11 is provided to isolate and protect the switching section from the outside, and movable element 18 in the form of a plate is disposed between surface sheet 11 and diaphragm 13 such that, when the switch is depressed, the depressing force is transmitted to diaphragm 13 by way of surface sheet 11 and movable element 18 to deform diaphragm 13 downwardly into contact with fixed contact element 16 to establish electrical connection between fixed contact elements 15 and 16 by way of diaphragm 13. Movable element 18 is provided in order to provide a definite click feeling by a turning over operation of diaphragm 13.

Indicium 19 such as a graphic pattern or figure or a character is printed at a portion of surface sheet 11 above movable element 18 as seen in FIG. 2. Indicium 19 is printed as a white-on-color representation from transparent or color ink having a light conducting property so that light from the rear or lower face of surface sheet 11 may be introduced to the upper face of surface sheet 11. Light emitting element 17 is disposed on printed circuit board 14 in the neighborhood of diaphragm 13.

Light emitted from light emitting element 17 is introduced to a location near diaphragm 13 by way of light emitting plate 12 in the form of a transparent flat plate provided on printed circuit board 14 and adapted to transmit light therethrough. Then, the light is scattered toward movable element 18 made of a material having a light conducting property. The light scattered to movable element 18 thus illuminates indicium 19 on the surface sheet 11 from the rear side.

The conventional flat keyboard switch described above is disadvantageous in that the assembling step in manufacture is complicated because it includes movable element 18 which is formed as an independent element.

Further, since movable element 18 and light transmitting plate 12 do not make a continuous structure but are formed as mutually independent elements with a spacing left therebetween, light emitted from light emitting element 17 and introduced by light introducing plate 12 is scattered while it passes the spacing between movable element 18 and light transmitting plate 12. Consequently, the conventional flat keyboard switch is also disadvantageous in that light emitted from the light emitting element is not utilized efficiently for the illumination and indicium 19 on surface sheet 11 may not be illuminated with sufficient light.

SUMMARY OF THE INVENTION

It is an object of the present invention to provide a flat keyboard switch which is prepared by a process which omits the assembly process of a movable plate.

It is another object of the present invention to provide a flat keyboard switch wherein light emitted from a light emitting element is utilized efficiently as a rear face illuminating light.

In order to attain the objects, according to the present invention, there is provided a flat keyboard switch, which comprises:

a printed circuit board having a plurality of fixed contacts and a light emitting element provided thereon;

a diaphragm disposed above the fixed contacts and serving as a movable contact for electrically connecting the fixed contacts to each other;

a surface sheet having an indicium printed at a portion thereof above the diaphragm, the indicium being made of a material having a light transmitting property;

a movable element disposed between the diaphragm and the surface sheet;

a light introducing plate disposed in the neighborhood of the light emitting element for scattering light emitted from the light emitting element toward the movable element; and a light introducing member interposed between the movable element and the light introducing plate being formed as a unitary member together with the movable element and the light introducing plate.

Preferably, a notched groove or a fold line is formed at each or either coupling portion between the movable element and the light introducing member and between the light introducing plate and the light introducing member.

Preferably, the movable element, the light introducing member and the light introducing plate are formed from a resin having flexibility.

The light introducing plate may be secured to the printed circuit board.

Preferably, the light introducing plate has a thickness greater than the height of the light emitting element.

With the flat keyboard switch, the assembly step for the movable element required in the conventional assembly process can be eliminated since the movable element is formed not as an independent member but as a unitary member together with the light introducing plate.

Further, since the movable element and the light introducing plate are coupled for flexible movement to each other by way of the light introducing member, light which propagates in the light introducing plate is scattered efficiently to the movable element by way of the light introducing member. Consequently, the indicium on the surface sheet can be illuminated with sufficiently intense light from the rear face side of the surface sheet.

The above and other objects, features and advantages of the present invention will become apparent from the following description referring to the accompanying drawings which illustrate a preferred embodiment of the present invention.

BRIEF DESCRIPTION OF THE DRAWINGS

FIG. 1 is a sectional view showing a conventional flat keyboard switch;

FIG. 2 is a plan view showing the conventional flat keyboard switch of FIG. 1 with the surface sheet;.

DETAILED DESCRIPTION OF THE PREFERRED EMBODIMENT

Figure 3:
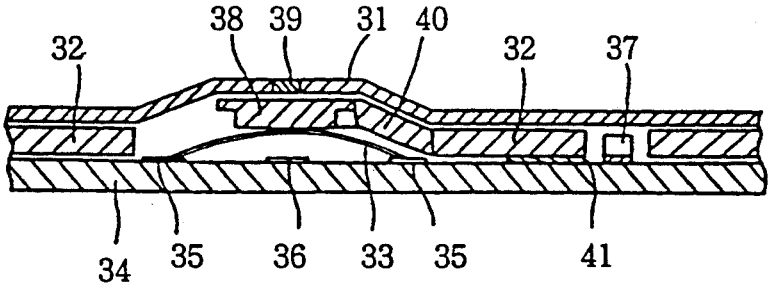
FIG. 3 is a sectional view showing a flat keyboard switch according to the present invention.
Figure 4:
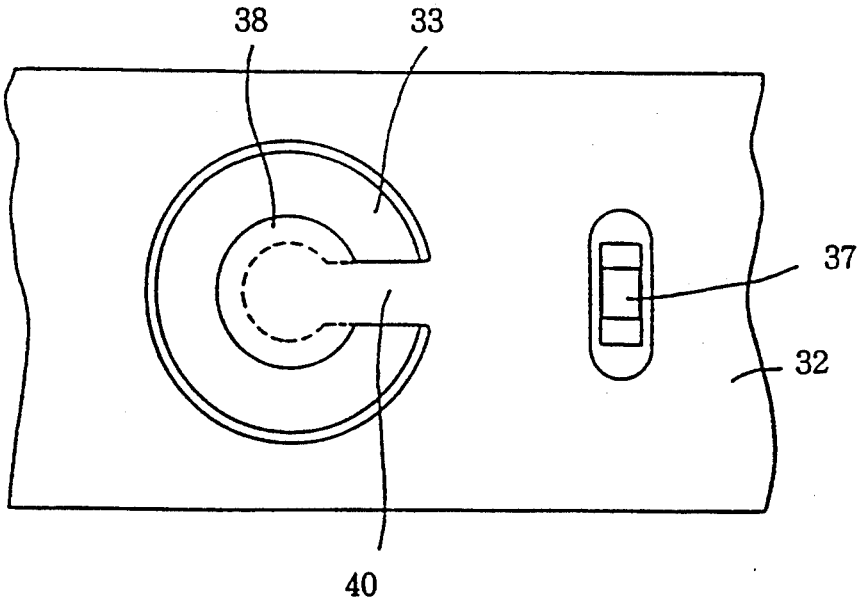
FIG. 4 is a plan view showing the flat keyboard switch of FIG. 3 with the surface sheet removed.

Referring to FIGS. 3 and 4, there is shown a flat keyboard switch according to the present invention. The flat keyboard switch includes surface sheet 31, diaphragm 33, printed circuit board 34, a pair of fixed contact elements 35 and 36, light emitting element 37 and indicium 39, which are similar to those of the conventional flat keyboard switch described above with reference to FIGS. 1 and 2.

In the flat keyboard switch of the present invention, movable element 38 in the form of a flat plate disposed above diaphragm 33 and light introducing plate 32 disposed in the neighborhood of diaphragm 33 are coupled for flexible or bending movement to each other by way of light introducing member 40.

Movable element 38, light introducing member 40, light introducing plate 32 and coupling portions for coupling them to each other are formed as a unitary member from a resin material having a light introducing property so that light emitted from light emitting element 37 is introduced to the rear face of indicium 39 by way of them.

Each of the coupling portions between movable element 38 and light introducing member 40 and between light introducing plate 32 and light introducing member 40 has a notched groove or a fold line formed thereon so that they may be flexibly bent relative to each other.

Each of the coupling portions between movable element 38 and light introducing member 40 and between light introducing plate 32 and light introducing member 40 may otherwise be formed with a reduced thickness so as to provide suitable resiliency. Alternatively, movable element 38, light introducing member 40 and light introducing plate 32 may be formed from polycarbonate which is superior in flexibility. Various other coupling structures may be available.

Movable element 38, light introducing member 40 and light introducing plate 32 are formed as a unitary member. Light introducing plate 32 is disposed in the neighborhood of light emitting element 37 and is secured to printed circuit board 34 by suitable adhesive means 41 such as a double-sided adhesive tape or a bonding agent. The adhesive means is intended to prevent, when the switch is depressed, movable element 38, light introducing member 40 and light introducing plate 32 from being moved integrally until light introducing plate 32 is brought into contact with light emitting element 37. Alternatively, a stopper element in the form of a protrusion may be formed on the upper face of printed circuit board 34 between light emitting element 37 and light introducing plate 32.

Preferably, light introducing plate 32 has a thickness greater than the height of light emitting element 37 on printed circuit board 34 in order to prevent light emitting element 37 from being acted upon by external force. In a preferred embodiment, light introducing plate 32 is 0.8 mm thick in accordance with the height of light emitting element 37 which projects 0.5 mm from printed circuit board 34.

Since movable element 38, light introducing member 40 and light introducing plate 32 are formed as a unitary member, the assembly step for movable element 38 is eliminated, and consequently, the assembly process is greatly simplified.

In operation, when surface sheet 31 is depressed, movable element 38 is pushed down by surface sheet 31, whereupon the end of light introducing member 40 adjacent to movable element 38, at which light introducing member 40 is coupled to movable member 38, is also pushed down. Diaphragm 33 is deformed by thus pushed down movable element 38 into contact with fixed contact element 36 thereby to electrically connect fixed contact elements 35 and 36 to each other to put the switch into an on-state. In the present embodiment, when the switch is in this on-state, movable element 38, light introducing member 40 and light introducing plate 32 are positioned substantially in a straight line or on the same plane. In this condition, light emitted from light emitting element 37 is introduced efficiently into movable element 38 by way of light introducing plate 32 and light introducing member 40 so that indicium 39 on surface sheet 31 is illuminated with intense light from the rear face side thereof.

As described above, the conventional flat keyboard switch shown in FIGS. 1 and 2 cannot utilize light emitted from light emitting element 17 efficiently for illumination because light is scattered while it passes the spacing which is provided between light introducing plate 12 and movable element 18.

On the contrary, with the flat keyboard switch of the present embodiment, since light introducing member 40 having a light introducing property is provided between light introducing plate 32 and movable element 38 and those three members are coupled for flexible movement to each other such that they are positioned, upon illumination, substantially in a same straightline or on the same plane, light emitted from light emitting element 37 and introduced into light introducing plate 32 is then introduced into movable element 38 by way of light introducing member 40 so that it is utilized efficiently for illumination.

It is to be noted that, where movable element 38, light introducing member 40 and light introducing plate 32 are formed as a unitary member from polycarbonate which is superior in flexibility, the unitary member does not have the specific coupling portions as described above, and consequently, light emitted the light emitting element 37 is always introduced to the rear face of indicium 39 on surface sheet 31. Accordingly, indicium 39 on surface sheet 31 is always illuminated with intense light irrespective of the connecting condition of the switch.

Although variations of the embodiment described above are possible, the scope of the present invention is defined in the appended claims.

What is claimed is:

1. A keyboard switch for providing an open and closed state between at least two of a plurality of fixed contacts in response to pressure on a surface sheet, said keyboard switch comprising:

a printed circuit board having said fixed contacts and a light emitting element provided thereon;

a diaphragm being disposed above said fixed contacts and serving as a movable contact for electrically connecting said fixed contacts to each other, said closed state occurring at least in response to pressure on said surface sheet causing an electrical connection between said at least two fixed contacts;

said surface sheet having an indicium at a portion thereof above said diaphragm, said indicium including a material having a light transmitting property;

a light transmission assembly formed as a unitary member for transmitting light from said light emitting element toward said indicium, said light transmission assembly comprising:

a light introducing plate for scattering light emitted from said light emitting element toward a light introducing member;

said light introducing member receiving and scattering light emitted from said light introducing element toward a movable element; and said movable element being disposed between said diaphragm and said surface sheet;

wherein at least when said diaphragm is in said closed state, said movable element, said light introducing member and said light introducing plate are in substantial alignment, generally along a common plane, thereby providing efficient light transmission through said light transmission assembly.

2. A keyboard switch as claimed in claim 1, wherein at least when said keyboard switch is not in said closed state, said movable element and said light introducing plate are substantially parallel, and in separate planes.

3. A keyboard switch as claimed in claim 1, wherein a first coupling portion is defined by adjacent ends of said movable element and said light introducing member and a second coupling portion is defined by adjacent ends of said light introducing plate and said light introducing member and wherein a notched groove or a fold line is formed at at least one of said first coupling portion and said second coupling portion.

4. A keyboard switch as claimed in claim 1, wherein said movable element, said light introducing member and said light introducing plate are formed from a resin having flexibility.

5. A keyboard switch as claimed in claim 1, wherein said light introducing plate is secured to said printed circuit board.

6. A keyboard switch as claimed in claim 5, wherein said light introducing plate is secured to said printed circuit board by an adhesive.

7. A keyboard switch as claimed in claim 1, wherein said light emitting element has a height, and said light introducing plate has a thickness greater than said height of said light emitting element.

8. A keyboard switch as claimed in claim 1, wherein said light introducing member receives light from said light introducing plate, and scatters said received light toward said movable element.

9. A keyboard switch as claimed in claim 1, further comprising holding means for holding said light introducing plate substantially fixed with respect to said light emitting element.

10. A keyboard switch as claimed in claim 9, wherein said holding means comprises an adhesive.

11. A keyboard switch as claimed in claim 1, wherein:

said light introducing plate is adjacent to said printed circuit board and affixed thereto.

12. A keyboard switch as claimed in claim 11, wherein:

a pressure region is defined by an area of said surface sheet adjacent to said moveable element;

a slope region is defined by an area of said surface sheet circumscribing said pressure region, wherein said surface sheet is spaced from said printed circuit board by a distance substantially greater than said height of said light introducing plate;

an outside region is defined by an area of the surface sheet circumscribing said slope region, wherein said surface sheet is spaced from said printed circuit board by a distance just greater than said height of said light introducing plate; and wherein said light emitting element is located between said printed circuit board and said surface sheet in said outside region.

* * * * *